US006027228A

United States Patent [19]

Adams et al.

[11] Patent Number: 6,027,228

[45] Date of Patent: Feb. 22, 2000

[54] CHRISTMAS TREE LAWN ORNAMENT

[75] Inventors: William E. Adams; Charles S. Burns, both of Portersville, Pa.

[73] Assignee: Adams Mfg. Corp., Portersville, Pa.

[21] Appl. No.: 08/891,650

[22] Filed: Jul. 11, 1997

[51] Int. Cl.[7] ..... F21P 1/02

[52] U.S. Cl. ..... 362/252; 362/250; 362/391; 362/431; 362/807

[58] Field of Search ..... 362/122, 123, 362/249, 250, 252, 258, 391, 431, 806, 807

[56] References Cited

U.S. PATENT DOCUMENTS

| | | | |
|---|---|---|---|
| 1,905,500 | 4/1933 | Propp | 362/252 |
| 3,704,366 | 11/1972 | Korb et al. | 362/249 |
| 4,404,621 | 9/1983 | Mauro | 362/252 |
| 4,620,270 | 10/1986 | Laakso | 362/123 |
| 4,720,773 | 1/1988 | Ahroni | 362/249 |
| 4,979,085 | 12/1990 | Voorhees | 362/252 |
| 5,481,444 | 1/1996 | Schultz | 362/249 |
| 5,568,966 | 10/1996 | Miller et al. | 362/252 |
| 5,712,002 | 1/1998 | Reilly, III | 362/123 |

*Primary Examiner*—Alan Cariaso
*Attorney, Agent, or Firm*—Buchanan Ingersoll, P.C.

[57] ABSTRACT

A Christmas tree lawn ornament has a pole with one end attached to a base which is anchored to the ground and a connector at the top. The pole is preferably assembled from several segments. Multiple guide wires are provided with one end attached to the connector and the other end anchored to the ground in a generally circular pattern at some distance from the base of the pole. Alternatively, a single stand of guide wire can be looped from headpiece, to stake, to headpiece, and so forth in a sinusoidal pattern. Multiple light holders are attached along the guide wires to which strings of decorative lights can be attached. A decorative star or other ornament is attached atop the connector.

30 Claims, 9 Drawing Sheets

CHRISTMAS TREE LAWN ORNAMENT

BACKGROUND OF THE INVENTION

1. Field of the Invention

The present invention relates to decorative lawn ornaments, and more particularly to a lighted Christmas tree lawn ornament.

2. Description of Related Art

Christmas season lawn ornaments, both lighted and unlighted, are well known in the art and are available in many configurations, from Christmas trees to elves to manger scenes to Santa's sleigh and reindeers. The most common types are constructed from plastic and are anchored to the ground with stakes. Many, if not most, are provided with electric lighting for enhanced effect at night. More closely related to the present invention is a pole embedded in the ground having multiple strings of lights strung from the top of the pole and then staked to the ground. This pattern forms a conical shape which resembles a Christmas tree, especially at night when the strings of lights are lit up and neither the pole nor the strings on which the lights are carried are visible. This type of tree typically is found in a commercial or public area, is over ten feet high, and was assembled by professionals. Some homeowners have created this type of tree in their yards. However, because of the time and skill required to make such a tree very few people make this decoration.

There are other disadvantages with this type of lighted Christmas tree. One such disadvantage is the fact that wind may cause the strings of electric lights to whip back and forth causing a fair amount of stress on both the lights and electrical wiring. Staking the light strings tighter to reduce the back and forth "whipping" may reduce that problem, but that creates increased tensile stress in the electrical wire. Another disadvantage with this arrangement is that variation in the appearance of the lighted "tree" are limited. The appearance of the "tree" is limited to vertically converging lines. As a result, the lights are much closer together, and thus appear brighter, at top of the ornament and more spread out and diffuse at the base. Because the spacing of the lights along a particular string of lights is fixed by the manufacturer the distance between lights on this "tree" cannot easily be changed. There are no ornaments or other types of decorations which can be used with this display. Only strings of electric lights are used. As a result, this type of tree is only visually appealing when the illuminated lights are visible Therefore, there is a need for a new Christmas tree lawn ornament that can be easily assembled by a homeowner, and which permits a greater variety of appearance. Additionally, such a lawn ornament should be able to hold different types of decorations besides electric lights so that the lawn ornament would be appealing in daylight hours as well as after dark.

SUMMARY OF THE INVENTION

We provide a Christmas tree lawn ornament having a pole with one end anchored to the ground and headpiece attached to the top of the pole. Multiple guide wires are provided which attach to the headpiece of the pole. The guide wires are anchored to the ground at some distance from the base of the pole in a spaced apart generally circular pattern. The outline of the guide wires form a conical shape simulating a Christmas tree. Multiple light holders are provided which can be slidingly attached to the guide wires. These light holders preferably are sized and shaped to hold a decorative light socket. Strings of electric lights or other decorations can then be attached to the light holders. The light holders allow strings of electric lights to be positioned parallel, perpendicular, or at varying angles to the guide wires. The light holders may be spaced apart from one another in a manner determined by the person who sets up the tree.

We prefer to make this tree in kit form containing pole segments, wire, stakes, light holders and a headpiece. The pole is assembled from several segments which have mating ends that are designed to be connected together. A connector fits on top of the pole, receives the guide wires and is also adapted to hold an ornament, such as a star. The same connector can be used to join two segments of pipe. The bottom of the pole is driven into the ground or a stake may be driven into the ground and the bottom of the pole is then attached to the stake. Alternatively, a flat base can be provided which is appropriately sized and weighted to either rest on the top of the ground or on a floor. In this alternative configuration, the base itself is provided with attachment points for the cords, thereby eliminating the need to anchor the free ends of the cords to the ground. This allows the Christmas tree lawn ornament to be used indoors, similarly to contemporary artificial Christmas trees, since it does not have to be permanently anchored.

Other details, objects, and advantages of the invention will become apparent from the following description and accompanying drawings of certain presently preferred embodiments thereof.

BRIEF DESCRIPTION OF THE DRAWING FIGURES

In the accompanying drawings, the preferred embodiments of the invention and preferred method of practicing the invention are illustrated in which.

DETAILED DESCRIPTION OF CERTAIN EMBODIMENTS

Figure 1:
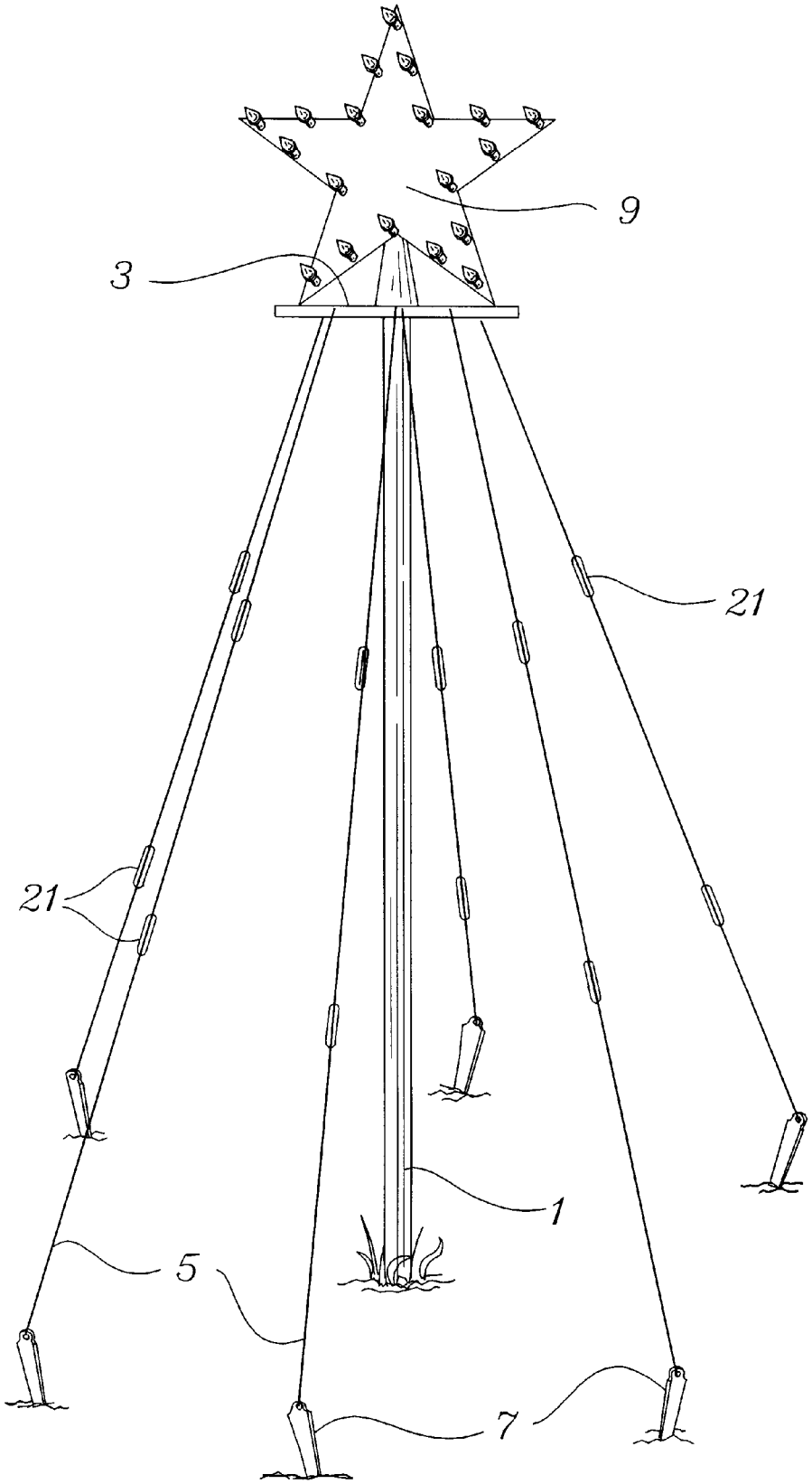
FIG. 1 is a perspective view of a present preferred embodiment of our Christmas tree lawn ornament.
Figure 10:
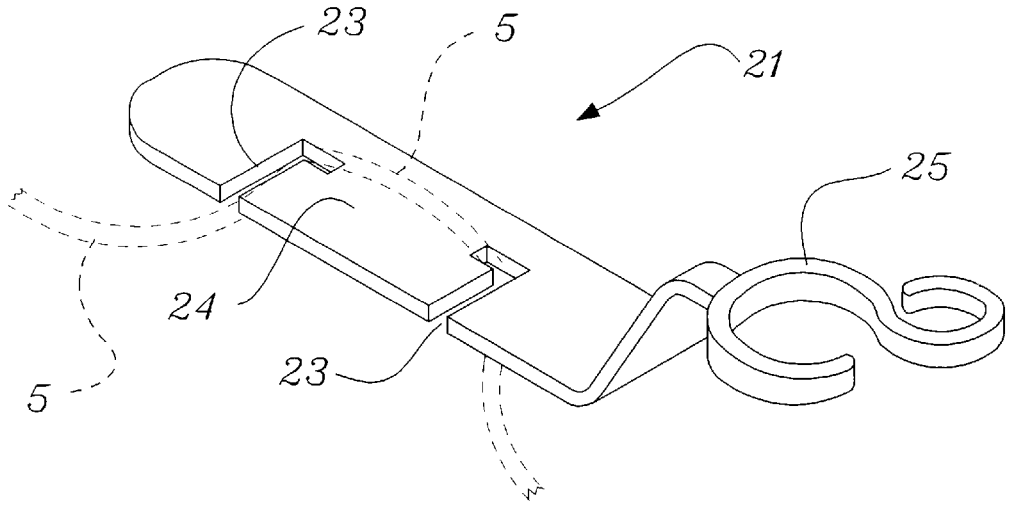
FIG. 10 is a perspective view of a presently preferred embodiment of a light holder.
Figure 11:
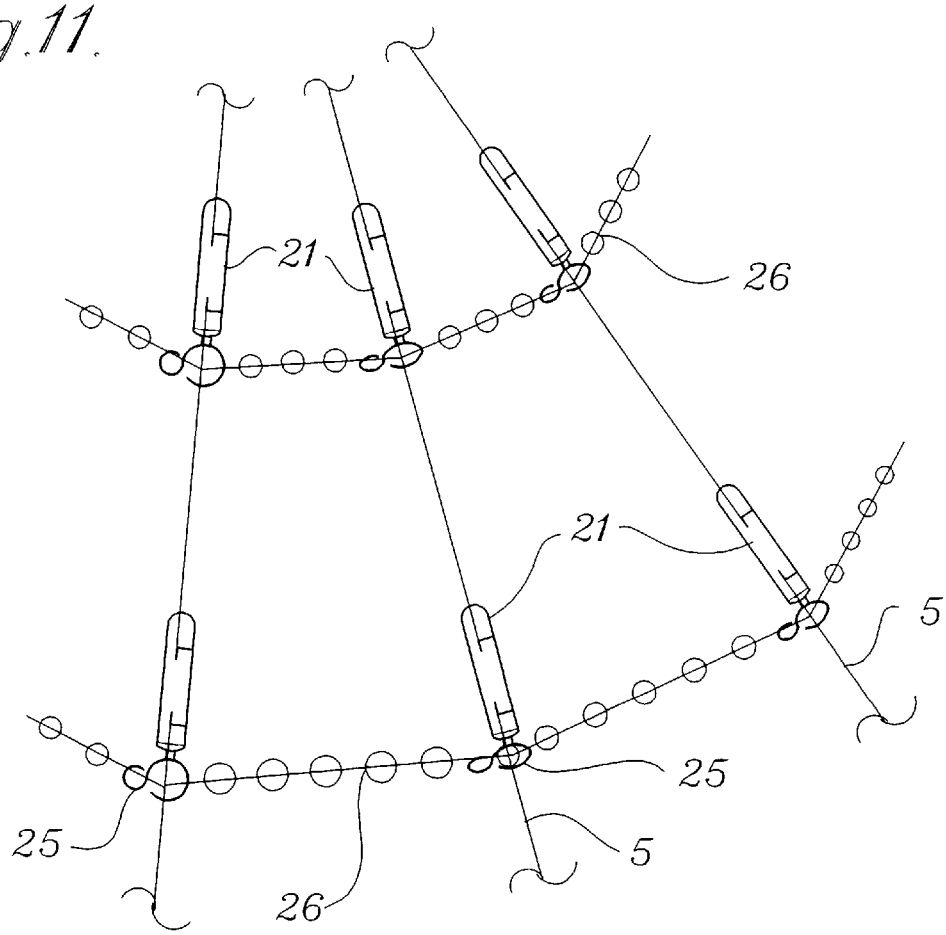
FIG. 11 is a perspective view partially in section illustrating how multiple light holders like the one shown in FIG. 9 may be positioned on the guide wires.

Referring now to the drawings wherein like reference numerals refer to similar or identical parts throughout the several views. A first presently preferred Christmas tree lawn ornament, shown in FIG. 1, includes a pole 1 that is anchored to the ground at the bottom and has a connector 3 which holds a star shaped ornament 9 at the top. Multiple guide wires 5 attach to the connector 3 and are anchored to the ground by stakes 7. We prefer to use stakes of the type shown in my United States Design Pat. No. D337,076, but any suitable stake having a top portion to which the ends of the guide wires 5 can be attached could be used. Decorative light holders 21 shown in FIGS. 10 and 11 are provided on the guide wires 5.

Figure 2:
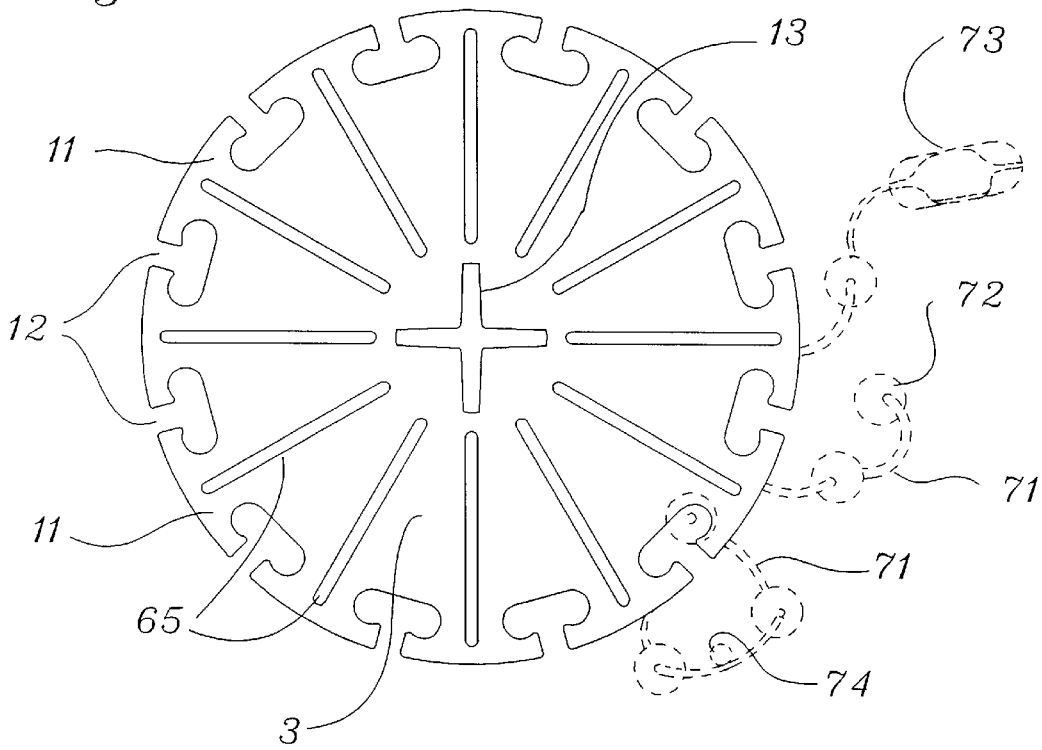
FIG. 2 is a top plan view of a present preferred connector used in the lawn ornament.
Figure 5:
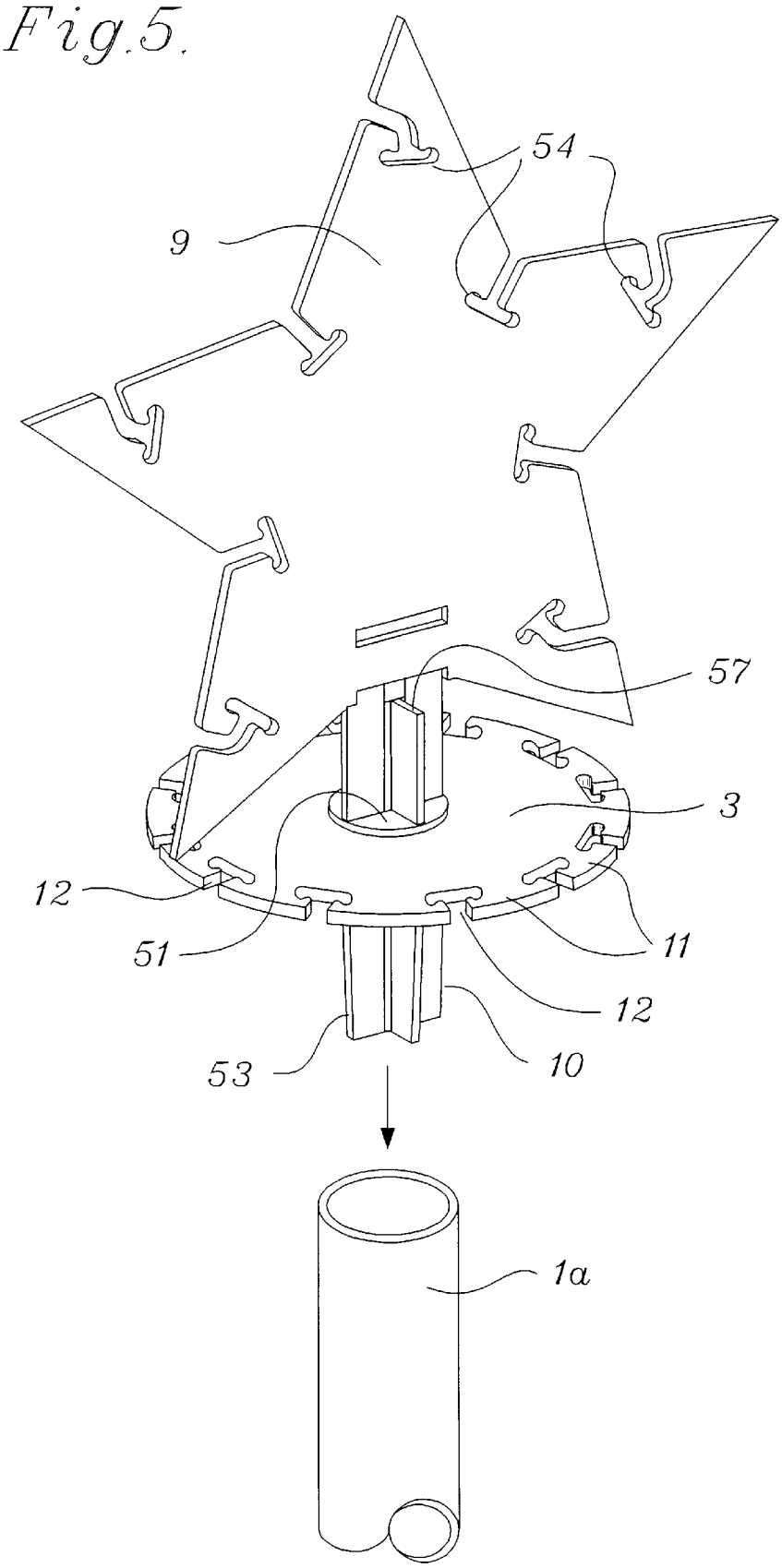
FIG. 5 is an exploded view illustrating connector attachment of a presently preferred ornament to the top segment of the pole in FIG. 4.
Figure 6:
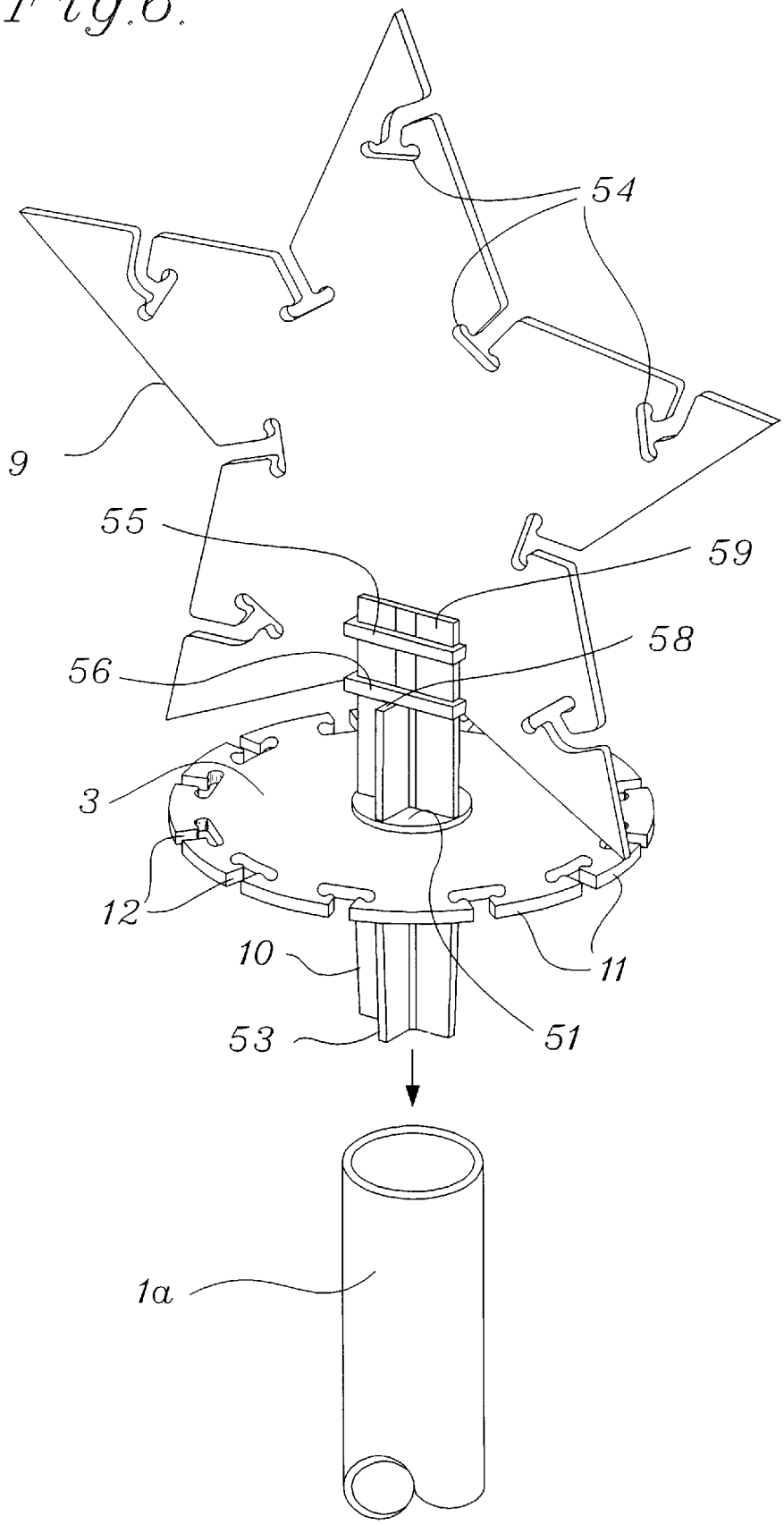
FIG. 6 is a rear view of the ornament and connector shown in FIG. 5.

The connector 3, shown most clearly in FIGS. 2 and 5, is shaped like a wheel with a number of spaced radially extending T-shaped protrusions 11 that form openings 12. Wires or light cords can be passed through these openings 12. The edges of the openings are rounded to prevent the light cords from being cut. Connector 3 is preferably a molded plastic part. If desired a plastic bead chain 71 shown in dotted lines in FIG. 2 can be threaded through or molded into the connector 3. The beads 72 are sized to fit into one opening 12 so that the bead chain 71 can encircle the wire or cord 74 being held. Alternate bead chains could have a connector 73 so that two adjacent chains could be joined together. One could use plastic strips which could be tied together in place of the bead chains. We prefer to provide an opening 13 in the center of the connector which is adapted to fit onto the mounting piece 10 as shown in FIGS. 5, 6, 7 and 8. The underside of the connector preferably has multiple radially spaced stiffeners 65 for added strength. The mounting piece 10 has four perpendicular legs 57 which are tapered at lower portion 53 to frictionally fit into a pole segment la as shown in FIG. 5. A stop 51 is provided near the middle of the mounting piece 10. The portion of the mounting piece 10 which is below stop 51 passes through the opening 13 in connector 3 and into pole segment 1*a*. In this way the connector 3 is held between pole 1 and the stop 51. The mounting piece 10 preferably is made so that the structure on either side of stop 51 is identical. Then, it makes no difference which end is inserted into the pole segment 1*a*.

The star-shaped ornament 9 has a pair of brackets 55 and 56 which fit over the tab 59 at the top mounting piece 10 holding the ornament in place. Alternatively, a tab may extend from the ornament which fits into a receiving slot in the connector 10. This type of construction is shown in my U.S. Pat. No. 5,419,527. The star-shaped ornament 9 is also provided with multiple decorative light holder openings 54 for holding a string of decorative lights.

Figure 7:
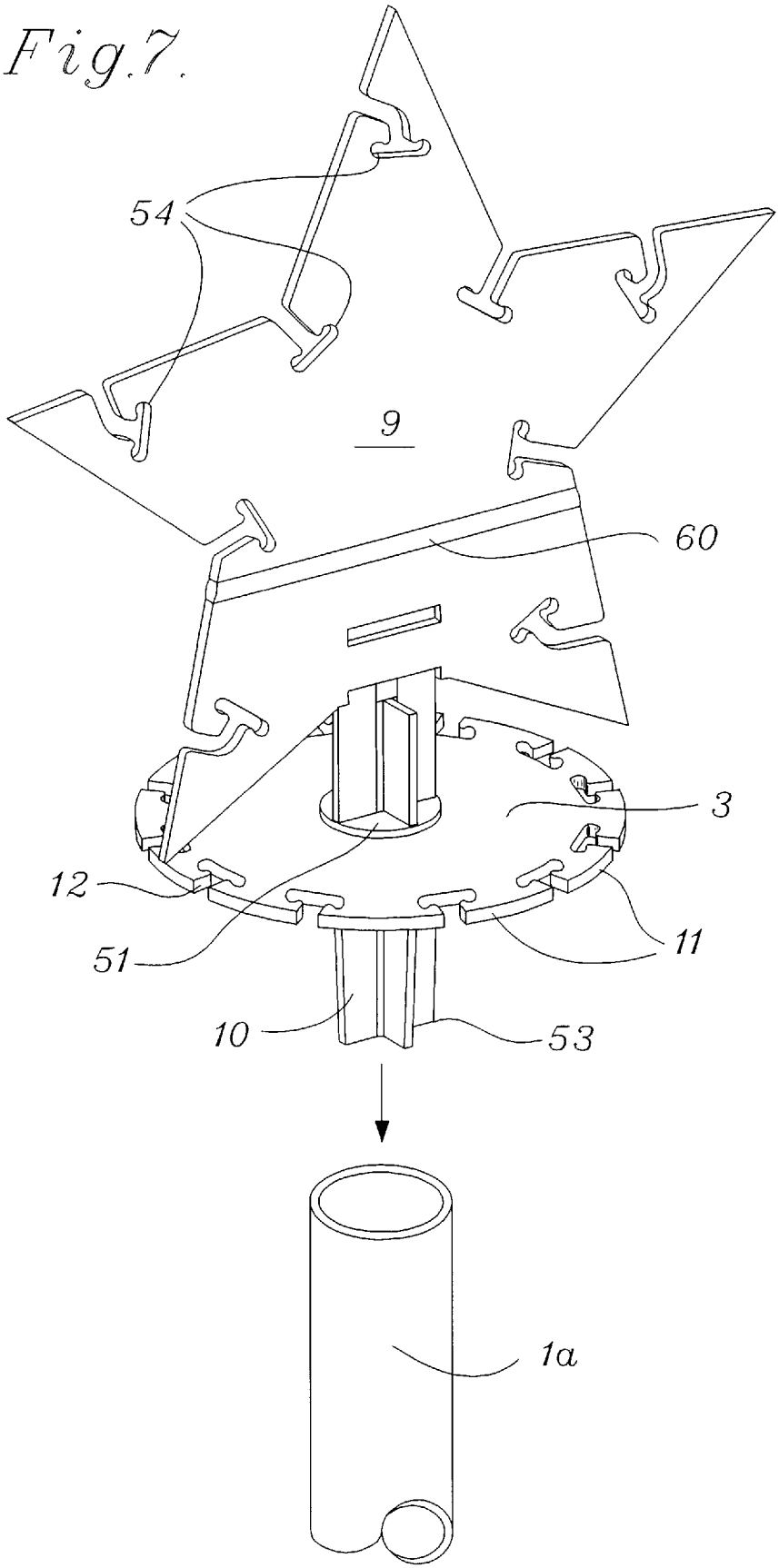
FIG. 7 is a perspective view of a second preferred ornament on a connector.
Figure 8:
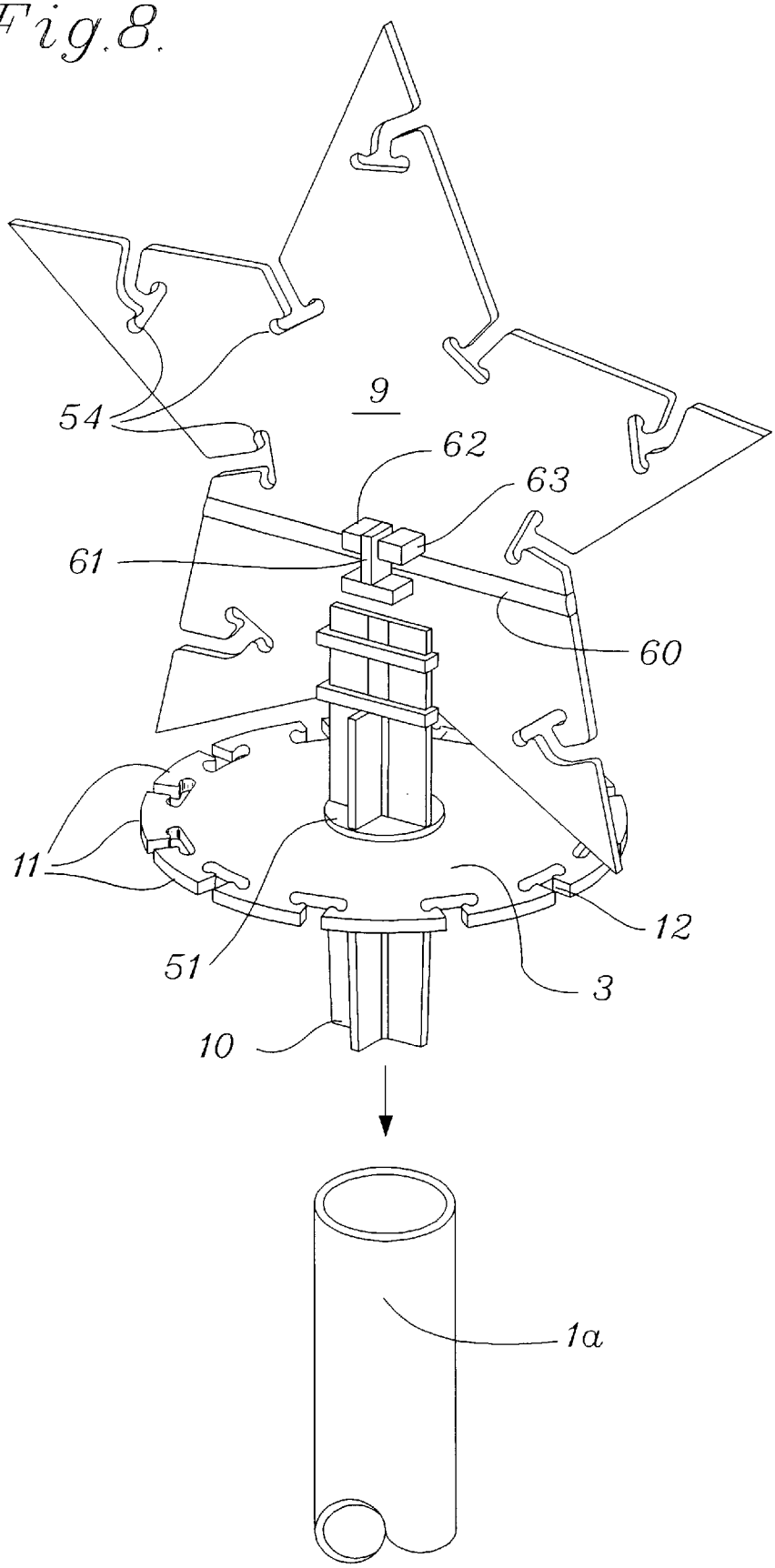
FIG. 8 is a rear view of the ornament and connector shown in FIG. 7.

We prefer to package the lawn ornament in kit form to be assembled by the user. The box for this item can have a narrow profile if the ornament 9 could be folded to a small size. Therefore, we prefer to provide a star-shaped ornament 9 having a living hinge 60 as shown in FIGS. 7 and 8. This ornament 9 can be folded to have a smaller width. The back of the starshaped ornament, shown in FIG. 8, has a locking member 61 which is sized to frictionally engage, or snap fit between, a pair of spaced apart holding members 62 and 63. In this manner the star-shaped ornament 9 can be locked in an open position or folded down for storage.

Figure 3:
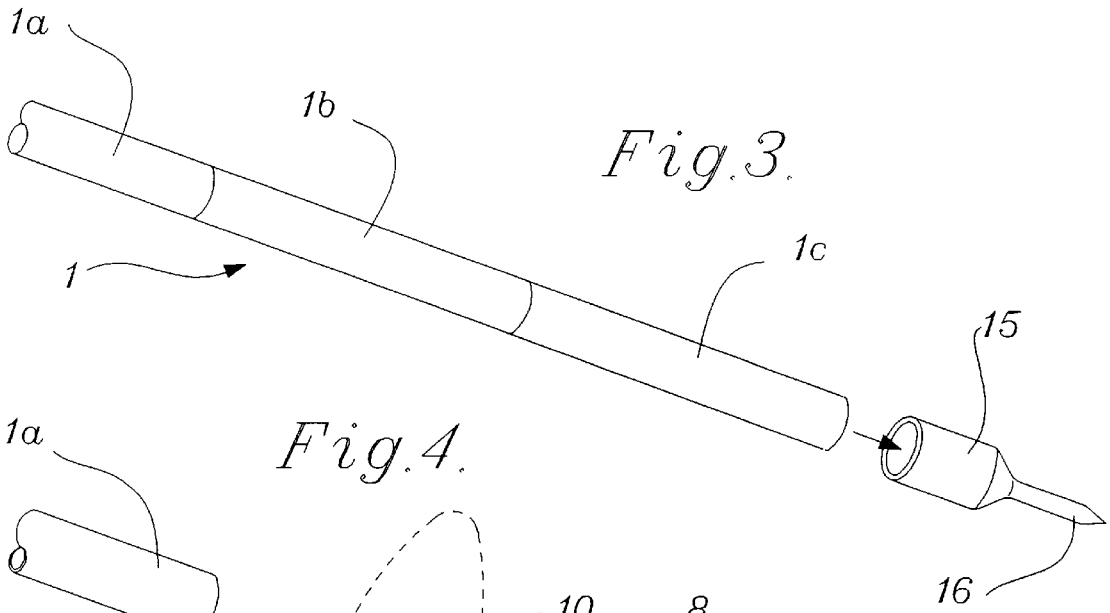
FIG. 3 is a perspective view of a present preferred pole used in the lawn ornament.
Figure 4:
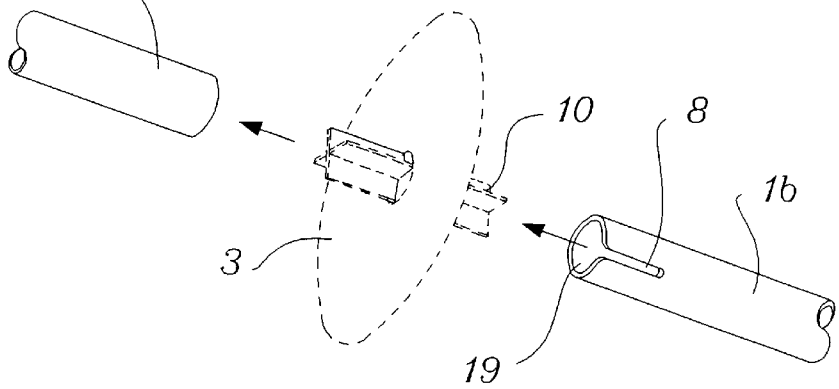
FIG. 4 is a perspective view partially in section illustrating how segments of the pole shown in FIG. 3 may be connected together with a present preferred base.
Figure 9:
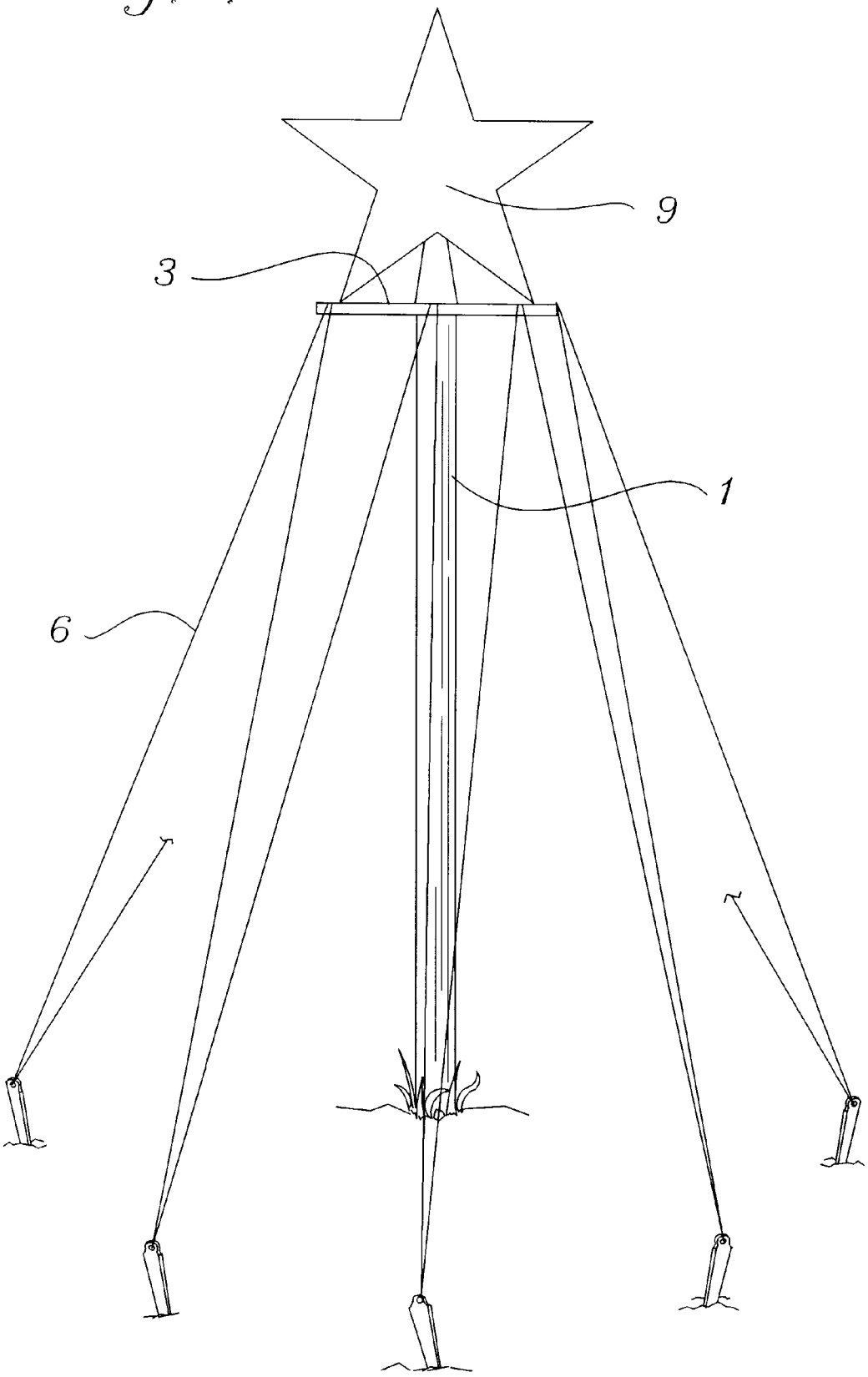
FIG. 9 is a perspective view of a presently preferred alternative embodiment of the invention illustrating the use of a continuous strand guide wire.

To construct the tree, the pole 1 is preferably assembled from two or more metal or plastic tubes 1*a*, 1*b*, and 1*c* of generally equal length as shown in FIG. 3. Opposite ends of the poles are sized so that the top end of one segment can fit into the bottom end of the adjacent segment. Preferably a slot 8 is provided in the end of the pole segment 1*b* that fits into the adjacent pole segment 1*a*. Alternatively, mounting piece 10 and connector 3 can be used to attach adjacent segments as shown in FIG. 4. Additionally, we prefer to provide a stake-like base 15 for the pole 1 which receives the bottom segment 1*c* as shown in FIG. 3. The spike portion 16 can be driven into the ground before the pole is inserted into the base. One end of each wire guide 5 is tied or otherwise attached to a T-shaped protrusion 11 and the other end is tied or otherwise attached to a stake 7 which anchors the guide wires 5 to the ground. The guide wires thus attached form the Christmas tree lawn ornament illustrated in FIG. 1. Alternatively, the guide wires may be looped from one stake 7 up around a T-shaped protrusion 11, then back down to the next stake 7 and back up around the next T-shaped protrusion 11, and so on. By looping the guide wire in sinusoidal manner like this a single strand of guide wire, of sufficient length, can be utilized to create the Christmas tree lawn ornament illustrated in FIG. 9.

Multiple light holders, preferably like the holder 21 illustrated in FIGS. 10 and 11, are provided which can be attached at various positions along the guide wires 5. The light holder 21 has a front holding portion 25 which is adapted to hold decorative lights. Preferably, this portion is resilient plastic and S-shaped, having a first opening sized to hold mini-light bulb sockets and a second opening sized to hold the larger standard size (C-4) and outdoor size (C-9) decorative light sockets. The light holder 21 could have tabs, slots or other structures adapted to hold other types of decorations. The flat rear portion 24 of the light holder 21 is provided with two narrow L-shaped slots 23 which are sized and configured to frictionally engage a guide wire 5 threaded through the slots. Holders can be placed at any desired position along a guide wire 5 as shown in FIG. 11. A light socket 24 from a string of decorative lights 26 is attached to the holding portion 25 of each light holder 21. Although a horizontal design is shown, the strings of lights 23 may also be positioned parallel to the guide wires 5, or at varying angles, according to personal preference.

The present tree can be packaged in kit form in a thin box not much taller than the length of the pole segments. Consequently, the product will require relatively little shelf space. The kit is easily assembled using only a hammer to anchor the pole and stakes.

Figure 12:
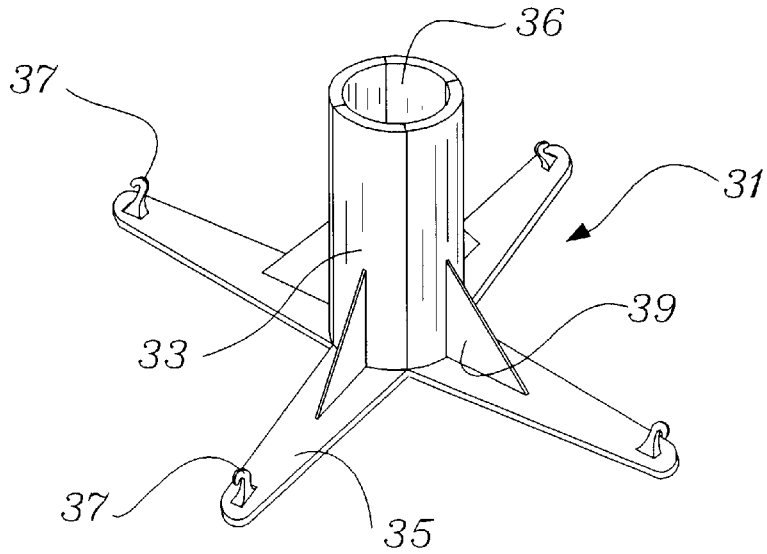
FIG. 12 illustrates a second presently preferred base.
Figure 13:
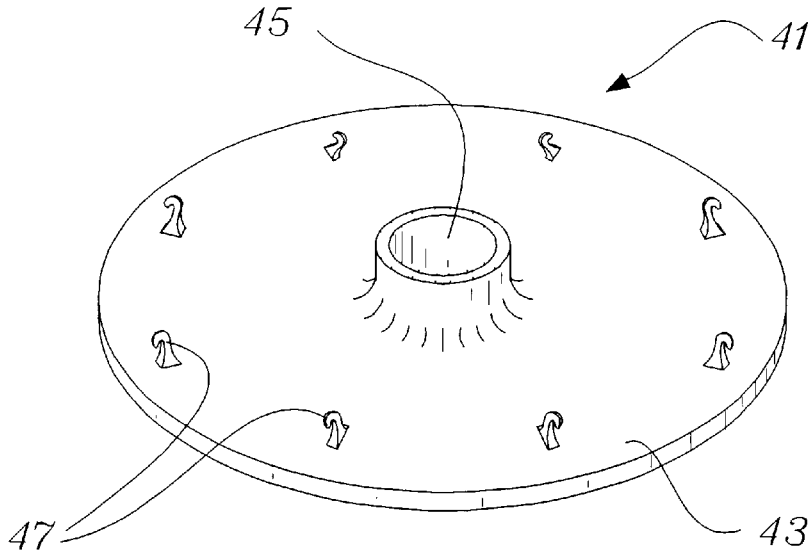
FIG. 13 illustrates a third presently preferred base.

The base 31 illustrated in FIG. 12, can be substituted for the base 15 shown in FIG. 3. This base 31 has a cylindrical cup 33 which holds the pole in opening 36. Removable legs 35 with braces 39, and guide wire attachment protrusions 37 are attached to the eye 33. In another alternative embodiment, a one piece base like that illustrated in FIG. 10 is used. This particular base 41 has a cup portion 45 for receiving a pole 1 and a round bottom portion 43 which is provided with multiple guide wire attachment protrusions 47. Either base 31 or 41 allow the tree to be portable, or used indoors.

Although the invention has been described in detail in the foregoing embodiments for the purpose of illustration, it is to be understood that the invention is not so limited but may be variously embodied with the scope of the following claims.

We claim:

1. A Christmas tree lawn ornament comprising:

a pole having a top end and a bottom end, said top end having a plurality of guide wire attachment points;

a plurality of anchors each having an anchoring end and a guide wire retaining end;

a plurality of guide wires each having first and second ends, each of said first ends attached to each of said plurality of guide wire attachment points, each of said second ends attached to each of said guide wire retaining ends; and a plurality of light holders each attached to said plurality of guide wires.

2. The Christmas tree lawn ornament of claim 1 also comprising an ornament attached to said top end.

3. The Christmas tree lawn ornament of claim 2 wherein said ornament has a plurality of holders for holding a string of decorative lights.

4. The Christmas tree lawn ornament of claim 1 further comprising a base attached to said bottom end.

5. The Christmas tree lawn ornament of claim 4 wherein said base further comprises a spike portion for anchoring said pole.

6. The Christmas tree lawn ornament of claim 4 wherein said base further comprises a bottom portion adapted to rest on top of a generally level surface, said base also having guide wire attachment points for attaching said second ends of said plurality of guide wires.

7. The Christmas tree lawn ornament of claim 1 wherein said anchors are stakes.

8. The Christmas tree lawn ornament of claim 1 wherein said pole further comprises a plurality of interconnected pole segments.

9. A Christmas tree lawn ornament comprising:

a pole having a top end and a bottom end, said top end having a plurality of guide wire attachment points;

a plurality of anchors each having an anchoring end and a guide wire retaining end;

a plurality of guide wires each having first and second ends, each of said first ends attached to each of said plurality of guide wire attachment points, each of said second ends attached to each of said guide wire retaining ends;

a plurality of light holders each attached to said plurality of guide wires;

said pole having a plurality of interconnected pole segments; and a connector attached between selected ones of said plurality of interconnected pole segments the connector having at least one of a slot and a fastener to which a cord can be attached.

10. A Christmas tree lawn ornament comprising:

a pole having a top end and a bottom end, said top end having a plurality of guide wire attachment points;

a plurality of anchors each having an anchoring end and a guide wire retaining end;

a plurality of guide wires each having first and second ends, each of said first ends attached to each of said plurality of guide wire attachment points, each of said second ends attached to each of said guide wire retaining ends;

a plurality of light holders each attached to said plurality of guide wires; and each of said plurality of light holders having a first end slidingly attachable to one of said plurality of guide wires, and a second end configured to hold a string of decorative lights.

11. The Christmas tree lawn ornament of claim 1 wherein at least one of said plurality of light holders is configured to hold a decorative light socket.

12. The Christmas tree lawn ornament of claim 1 further comprising a connector attached to said top end, said connector having a plurality of guide wire retainers, and wherein said first ends of said plurality of guide wires are attached to said plurality of guide wire retainers.

13. The Christmas tree lawn ornament of claim 12 also comprising an ornament attached atop said connector.

14. A Christmas tree lawn ornament comprising:

a pole having a top end and a bottom end, said top end having a plurality of guide wire attachment points;

a plurality of anchors each having an anchoring end and a guide wire retaining end;

a length of guide wire sinusoidally looped from each of said plurality of guide wire attachment points to each said guide wire retaining end; and a plurality of light holders each attached to said guide wire.

15. The Christmas tree lawn ornament of claim 14 also comprising an ornament attached to said top end.

16. The Christmas tree lawn ornament of claim 15 wherein said ornament has a plurality of holders for holding a string of decorative lights.

17. The Christmas tree lawn ornament of claim 14 further comprising a base attached to said bottom end.

18. The Christmas tree lawn ornament of claim 14 wherein said anchors are stakes.

19. The Christmas tree lawn ornament of claim 14 wherein said pole further comprises a plurality of interconnected pole segments.

20. A Christmas tree lawn ornament comprising:

a pole having a top end and a bottom end, said top end having a plurality of guide wire attachment points;

a plurality of anchors each having an anchoring end and a guide wire retaining end;

a length of guide wire sinusoidally looped from each of said plurality of guide wire attachment points to each said guide wire retaining end;

a plurality of light holders each attached to said guide wire;

said pole having a plurality of interconnected pole segments; and a connector attached between selected ones of said plurality of interconnected pole segments, the connector having at least one of a slot and a fastener to which a cord can be attached.

21. A Christmas tree lawn ornament comprising:

a pole having a top end and a bottom end, said top end having a plurality of guide wire attachment points;

a plurality of anchors each having an anchoring end and a guide wire retaining end;

a length of guide wire sinusoidally looped from each of said plurality of guide wire attachment points to each said guide wire retaining end;

a plurality of light holders each attached to said guide wire;

each of said plurality of light holders having a first end slidingly attachable to said guide wire, and a second end configured to hold a string of decorative lights.

22. The Christmas tree lawn ornament of claim 14 wherein at least one of said plurality of light holders is configured to hold a decorative light socket.

23. The Christmas tree lawn ornament of claim 14 further comprising a connector attached to said top end, said connector having a plurality of guide wire retainers, and wherein said guide wire is sinusoidally looped from each of said plurality of guide wire retainers to each said guide wire retaining end.

24. The Christmas tree lawn ornament of claim 23 also comprising an ornament attached atop said connector.

25. A Christmas tree lawn ornament kit having component parts, comprising:

a. a plurality of pole segments adapted to be assembled into a pole;

b. at least one connector adapted to connect to a top portion of said pole, said at least one connector having a plurality of guide wire retainers;

c. a plurality of stakes;

d. a sufficient length of guide wire to extend between each of said plurality of guide wire retainers to each of said plurality of stakes to hold said pole in a generally upright position; and e. a plurality of decorative light holders each adapted to be attached to said guide wire.

26. The kit of claim 25, further comprising an ornament adapted to be attached atop said connector.

27. The kit of claim 25 wherein said sufficient length of guide wire comprises a plurality of guide wires each being of sufficient length to extend from one of said plurality of guide wire retainers to one of said plurality of stakes.

28. The kit of claim 25 wherein said sufficient length of guide wire comprises a spool of guide wire, said spool containing a length of guide wire sufficiently long to be looped in a sinusoidal manner from each of said plurality of guide wire retainers to each of said plurality of stakes.

29. A Christmas tree lawn ornament comprising:

a pole having a top end and a bottom end;

a connector having a top, a bottom, and a circumference in which there is provided a plurality of slots sized to accept a light cord, the bottom of the connector attached to the pole so that a longitudinal axis running through the pole is normal to a plane passing through the circumference; and an ornament attached to the top of the connector, the ornament having openings sized to receive a string of decorative lights.

30. The Christmas tree lawn ornament of claim 29 also comprising a plurality of anchors and at least one string of decorative lights running from the connector to the anchors.

* * * * *